US006300051B1

(12) United States Patent
Van den Zegel et al.

(10) Patent No.: US 6,300,051 B1
(45) **Date of Patent: *Oct. 9, 2001**

(54) METHOD TO SPECTRALLY SENSITIZE TABULAR SILVER HALIDE GRAINS

(75) Inventors: Marc Van den Zegel, Boortmeerbeek; Kathy Elst, Kessel, both of (BE)

(73) Assignee: Agfa-Gevaert, Mortsel (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/271,372

(22) Filed: Mar. 18, 1999

Related U.S. Application Data

(60) Provisional application No. 60/089,264, filed on Jun. 15, 1998.

(30) Foreign Application Priority Data

Apr. 29, 1998 (EP) ..... 98201401

(51) Int. Cl.[7] ..... G03C 1/00

(52) U.S. Cl. ..... 430/569; 430/572; 430/577; 430/581; 430/583

(58) Field of Search ..... 430/572, 577, 430/569, 567, 583, 581

(56) References Cited

U.S. PATENT DOCUMENTS

| | | | | |
|---|---|---|---|---|
| 3,837,862 | * | 9/1974 | Shiba et al. | 430/577 |
| 5,141,846 | | 8/1992 | Fickie et al. . | |
| 5,376,523 | * | 12/1994 | Henry et al. | 430/572 |

FOREIGN PATENT DOCUMENTS

| | | |
|---|---|---|
| 0 556 413 A1 | 8/1993 | (EP) . |
| 0 678 772 A1 | 10/1995 | (EP) . |
| 0 712 034 A1 | 5/1996 | (EP) . |

OTHER PUBLICATIONS

Patent Abstracts of Japan, vol. 014, No. 430 (P–1106), Sep. 14, 1990 & JP 02 167539 A (Fuji Photo Film Co. Ltd.)., Jun. 27, 1990.

* cited by examiner

*Primary Examiner*—Thorl Chea
(74) *Attorney, Agent, or Firm*—Breiner & Breiner, L.L.C.

(57) ABSTRACT

A method has been disclosed for preparing a tabular silver halide emulsion wherein tabular silver halide grains having an average aspect ratio of at least 2:1, an average crystal diameter from 0.3 μm to 3.0 μm and an average thickness of less than 0.50 μm account for at least 50% of the total projective surface area of said grains, said method comprising the steps of precipitating, spectrally sensitizing and chemically ripening said grains, characterized by spectrally sensitizing by adding to the emulsion grains before chemically ripening at least one J-band aggregating spectrally sensitizing dye and at least one non-J-band aggregating dye. A light-sensitive silver halide emulsion having at least one J-band aggregating dye and at least one non-J-band aggregating dye comprising said tabular grains has also been disclosed as well as a light-sensitive silver halide photographic X-ray material comprising a support, at least one hydrophilic colloid layer on at least one side of said support and one or more photosensitive layer(s) comprising the said silver halide photographic emulsion and a radiographic screen-film combination comprising at least one X-ray intensifying screen in operative association with the said material.

6 Claims, No Drawings

METHOD TO SPECTRALLY SENSITIZE TABULAR SILVER HALIDE GRAINS

The application claims the benefit of U.S. Provisional Application No. 60/089,264 filed Jun. 15, 1998.

1. FIELD OF THE INVENTION

The present invention relates to a method of preparing a photosensitive emulsion having spectrally sensitized {111} tabular silver halide crystals showing an improvement in sensitivity (speed) to (preferably) visible green light, emitted by intensifying screens having green-light emitting luminescent phosphors, wherein said emulsion is suitable for use in a light-sensitive silver halide photographic film material applicable in a radiographic screen-film combination comprising at least one X-ray intensifying screen in operative association with the said film material.

2. BACKGROUND OF THE INVENTION

The effects of various precipitation conditions on the formation of silver halide emulsions comprising tabular crystals have been studied extensively as the said tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes U.S. Pat. Nos. 4,063,951; 4,067,739; 4,150,994; 4,184,877 and 4,184,878. However the tabular grains described herein cannot be regarded as showing a high diameter to thickness ratio, commonly termed aspect ratio. In a number of U.S. applications filed in 1981 and issued in 1984 tabular grains with high aspect ratio and their advantages in photographic applications are described as, e.g., in U.S. Pat. Nos. 4,434,226; 4,439,520; 4,425,425; 4,425,426 and 4,433,048. A survey on high aspect ratio silver halide emulsions appeared in Research Disclosure, Vol 225, January 1983, Item 22534.

The above cited references on tabular grains are mainly concerned with high sensitive silver bromide or silver bromoiodide emulsions. Tabular grain emulsions having a high aspect ratio are known to provide several advantages over more conventional spherical grains as e.g. a high covering power, a high (spectral) sensitivity and a lower coating weight, which saves costs in manufacturing. Said lower coating weight is especially preferred if rapid processing applications are required, which is nowadays an ever more returning demand.

Spectrally sensitizing dyes are well known in the art of photography, especially for green and red sensitization of flat tabular grains, whereas for blue and/or ultraviolet sensitization the number of examples is rather limited. Further it is known to use in radiography combinations of green-emitting phosphor screens with film materials containing green sensitized tabular grain emulsions. After processing of exposed emulsion grains residual amounts of dyes may be present, especially due to the presence of huge amounts of spectral sensitizing dyes as tabular grains have a large specific surface capable of adsorbing said huge amounts. Those huge amounts are further in favour of high speed and image quality (especially sharpness), required in diagnostic imaging where it is further of utmost importance to reduce irradiation of the patient to minimum levels.

Specific layer arrangements developed in order to get the desired features mentioned hereinbefore have been described e.g. in JP-A's 08006192, 08076305 and 09197625; in EP-A's 0 661 592, 0 693 190 and 0 770 909 and in U.S. Pat. Nos. 4,585,729; 5,380,636; 5,718,994 and 5,460,916.

Especially in mammographic applications, wherein, for reasons of good image definition light-sensitive layers are present on only one side of the film support, and where image formation proceeds with a system consisting of only one intensifying screen, a high speed, a high contrast (preferably a high "toe contrast") and low residual dye stain are desired. Specific measures taken therefor have e.g. been described in U.S. Pat. No. 5,290,655; in EP-A's 0 264 788 and 0 577 027 and in Research Disclosure No. 33487 (1992), p. 161.

3. OBJECTS OF THE INVENTION

Therefore it is an object of the present invention to provide emulsions and a method to prepare such emulsions, comprising spectrally sensitized {111} tabular silver halide grains showing an improvement in sensitivity (speed) to visible green light, emitted by intensifying screens having green-light emitting luminescent phospors.

It is another object to provide radiographic screen-film combinations comprising at least one X-ray intensifying screen in operative association with a photographic element comprising tabular grains spectrally sensitized to the green spectral region, wherein said grains are sensitive to low irradiation levels and wherein after exposure thereto, fog is low and dye stain is absent after processing.

It is a further object to provide, especially in mammographic applications, a desired high contrast in favour of image definition after processing, in combination with a high speed, a low fog and the absence of dye stain.

Other objects will become apparent from the description hereinafter.

4. SUMMARY OF THE INVENTION

According to the present invention a method is provided for preparing a tabular silver halide emulsion wherein tabular silver halide grains rich in silver bromide having an aspect ratio of at least 2:1, an average crystal diameter between 0.3 $\mu$m and 3.0 $\mu$m and an average thickness of less than 0.50 $\mu$m account for at least 50% of the total projective surface area of said grains, and wherein said method comprises the steps of precipitating, spectrally sensitizing and chemically ripening said grains, characterized by spectrally sensitizing the emulsion grains by adding before chemically ripening at least one J-band aggregating and at least one non-J-band aggregating dye.

A light-sensitive silver halide emulsion comprising tabular grains having an aspect ratio of at least 2:1, an average crystal diameter between 0.3 $\mu$m and 3.0 $\mu$m and an average thickness of less than 0.50 $\mu$m accounting for at least 50% of the total projective surface area of said grains, further having at least one J-band aggregating spectrally sensitizing dye and at least one non-J-band aggregating dye is also provided by the present invention, wherein said material preferably is an X-ray material comprising a support, at least one hydrophilic colloid layer on at least one side of said support and one or more photosensitive layer(s) comprising a silver halide photographic emulsion as disclosed above.

Further according to a preferred embodiment of the present invention a radiographic screen-film combination comprising at least one X-ray intensifying screen in operative association with the material as set forth has also been claimed.

5. DETAILED DESCRIPTION

Spectrally sensitizing dyes, more preferably those of the J-band aggregating sensitizing type, are adsorbed on the surface of tabular silver halide grains in an amount sufficient to optimally sensitize said tabular silver halide grains. As is well known in the art of photography, e.g. from F. M. Hamer, "Cyanine Dyes and Related Compounds" (1964), p. 710, J.Wiley, Interscience and from T. H. James, "The Theory of the Photographic Process", 4th Edition, MacMillan 1977, Chapter 8, the sensitization maximum of a sensitizing dye in a silver halide emulsion, also called M-band sensitization due to molecular absorption, is situated near the absorption maximum of the free dye in an aqueous solution. Certain sensitizing dyes have a sharp sensitization band, or even peak, at a slightly longer wavelength (about 20–50 nm) than the wavelength corresponding to the M-band sensitization maximum. This is known in the art as "J-band sensitization" and the dyes are known as "J-band spectrally sensitizing dyes" or "J-band aggregating dyes". Opposite thereto are the so-called "non-J-band aggregating dyes" which do not show the phenomenon of showing the sharp band or peak as described.

From indirect data there is a general acceptance that J-band aggregating spectrally sensitizing dyes consist of the nearly planar dye molecules adsorbed to silver halide surfaces along their long edge with their molecular planes stacked parallel to each other forming a two-dimensional crystal. According to theoretical calculations bathochromic absorption shifts, characteristic for the presence of J-aggregates depend on the angle of slippage between successive molecular planes. Measurements of the dyes' luminescence were the most accurate in order to proove J-aggregation as has been described in Springfield at the IS&T Congress, Nov. 8–13, 1992 by J. E. Maskasky, particularly with respect to J-aggregation on gelatin-grown tabular silver bromide microcrystals. More recent publications are related with thermodynamic analysis of repeated adsorption-desorption phenomena during growth of said aggregates at the surface of silver halide grains as has e.g. been described in J.Phys.Chem. Vol.101(1997), p. 2149–2153. Recently used techniques as analytical color fluorescence electron microscopy (ACFEM), ultra low energy scanning electron microscopy (ULESEM) and atomic force microscopy (AFM) in order to study the formation and properties of J-aggregates of e.g. cyanine dyes have been described in J.Phys.Chem. Vol.100(1996), p. 17287–17296. A survey of the J-aggregation phenomenon of spectral sensitizers with respect to structure and spectroscopy has further been published Jan. 1, 1996 in J.Soc.Phot. Sci.Technol.Japan, Vol. 59, p. 250–259. Former investigations of the sensitizing efficiency of J-aggregates on silver bromide as a function of the aggregate size by means of measurements of the dependence of fluorescence lifetimes and relative quantum yields have been disclosed in J.Phys.Chem. Vol.96(1992), p. 2783–2790. Most well-known techniques used since quite a lot of years are fluorescence and phosphorescence spectra of dyes as has been described in review articles in J.Aufzeich-nungsmaterialien (1973) (see e.g. p.157–180 and p. 237–252).

According to the present invention a method for preparing a tabular silver halide emulsion is offered wherein tabular silver halide grains having an average aspect ratio of at least 2:1, an average crystal diameter from 0.3 $\mu$m to 3.0 $\mu$m and an average thickness of less than 0.50 $\mu$m account for at least 50% of the total projective surface area of said grains, said method comprising the steps of precipitating, spectrally sensitizing and chemically ripening, characterized by spectrally sensitizing the said grains by adding before chemically ripening at least one J-band aggregating and at least one non-J-band aggregating dye.

In one embodiment of the present invention a method is offered wherein said J-band aggregating dye has a maximum J-band absorption in the wavelength range from 540 nm to 555 nm and wherein said non-J-band aggregating dye absorbs irradiation having a wavelength of less than 500 nm, more preferably between 380 and 500 nm and still more preferably between 420 and 460 nm.

In another embodiment according to the present invention a method is offered, wherein said J-band aggregating dye is a cyanine dye and wherein said non-J-band aggregating dye is a merocyanine dye.

More preferred according to the method of the present invention said cyanine dye corresponds to the formula (I)

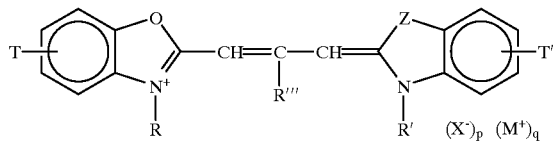

wherein represents a nitrogen or an oxygen atom and is substituted with R' if Z is a nitrogen atom, R, R' and R" each independently represent substituted or unsubstituted alkyl, R"' represents hydrogen, substituted or unsubstituted alkyl or substituted or unsubstituted aryl, T and T' may each independently represent the usual substituents known in the art, $(x^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound.

In a more preferred embodiment in the method according to the present invention in the said formula (I)

R"' is $—C_2H_5$, Z is an oxygen atom, at least one of R and R' represents a sulphoalkyl group, preferably corresponding to the formulae $$—(CH_2)_nSO_3^-$$

wherein n equals 2, 3 or 4, $$—(CH_2)_2—CH(CH_3)—SO_3^-$$

and $$—CH_2—CHY—CH_2—SO_3^-$$

wherein Y represents —OH or —Cl;

a sulphatoalkyl group, preferably corresponding to the formula $$—(CH_2)_nOSO_3^-$$

wherein n equals 2, 3 or 4, an acylsulphonamido group, preferably corresponding to the formulae $$—(CH_2)_n—C(O)—N(R'''')—SO_2—(CH_2)_mH$$

wherein n equals 1, 2 or 3;

m equals 1, 2, 3, etc.

$$—(CH_2)_r—SO_2—N(R'''')—SO_2—(CH_2)_sH$$

wherein r equals 2, 3 or 4; s equals 1, 2, 3, etc., $$—(CH_2)_v—SO_2N(R'''')—C(O)—(CH_2)_wH$$

wherein v equals 2, 3 or 4;

w equals 1, 2, 3, etc.

wherein R'''' represents H or alkyl;

and wherein T and T' each independently represent 5-phenyl, 5-Cl, 5-$OCH_3$ and 5-$CH_3$.

In a further preferred embodiment according to the method of the present invention in the said formula (I) R''' is hydrogen, Z is an nitrogen atom, T represents 5-phenyl, 5-Cl, 5-$OCH_3$ or 5-$CH_3$ and wherein T' represents 5,6-$(Cl)_2$; 5-CN-6-Cl; 5-$CF_3$-6-Cl; 5-Cl; 5-CN, 5-$CF_3$, 5-$CHF_2$, 5-$SO_2CH_3$ or 5-$SO_2R'''''$ (R''''' representing a fluoro-substituted or non-fluoro-substituted alkyl group), 5-COOR''''' and 5-$SO_2$-N($R^x$) ($R^y$) or 5-CO-N($R^x$) ($R^y$), wherein $R^x$ and $R^y$ each independently represent substituted or unsubstited alkyl groups, which may form a ring with the N-atom to which they are attached.

Still more preferred according to the method according to the present invention in the formula (I) Z represents oxygen and T and T' each represent Cl or T represents Cl and T' represents Phenyl or vice versa and wherein further R and R' represent all combinations of the formulae $$—(CH_2)_nSO_3^-$$

wherein n equals 2, 3 or 4, $$—(CH_2)_2—CH(CH_3)—SO_3^-$$

and $$—CH_2—CHY—CH_2—SO_3^-$$

wherein Y represents —OH or —Cl;

and wherein R, corresponding to the formulae given above, is combined with R' corresponding to the formulae $$—(CH_2)_jH$$

wherein j equals 1, 2, 3 or 4;

$$—CH_2—Phen—SO_3^-$$

$$—CH_2—Phen—COOH$$

$$—(CH_2)_k—Phen—COOH$$

wherein k equals 1, 2 or 3.

In a particular embodiment according to the method of the present invention said spectral sensitizer is anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyloxa-carbocyanine hydroxide.

According to the method of the present invention said non-J-aggregating dye used in combination with the J-aggreagating dye as described hereinbefore corresponds to the general formula (II), (II)

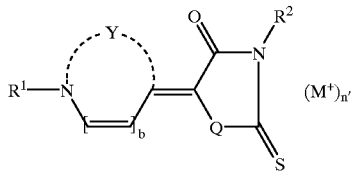

wherein

Y represents the atoms, necessary to form a heterocyclic 5- or 6-membered ring;

Q represents S, $NR^3$, O, or —(C=O)—N($R^4$)—;

$M^+$ represents a cation;

n' equals 0, 1, or 2;

b equals 0 or 1;

$R^1$, $R^2$, $R^3$ and $R^4$ each independently represent a $C_1$–$C_5$ alkyl chain, with the proviso that at least one of $R^2$, $R^3$ and $R^4$ has a solubilizing group or a latent alkali solubilizing group.

In one embodiment according to the method of the present invention said dye corresponds to the general formula (II), the alkyl chain containing at least one solubilizing group corresponds to one of the following formulae:

$$(CH_2)_mSO_3^- \text{ or } (CH_2)_mN(R)SO_3^-$$

wherein m equals 1, 2, 3 or 4, and wherein R has the same meaning as $R^1$ to $R^4$;

$$(CH_2)_2CH(Y)SO_3^-$$

wherein Y represents $CH_3$—, —Cl or —OH;

$$(CH_2)_cOSO_3^-$$

wherein c equals 2 or 3;

$$(CH_2)_dCO_2^-(H^+)$$

wherein d equals 1, 2 or 3;

$$(CH_2)_sO_2^-(CH_2)_tH$$

wherein s equals 2 or 3 and t equals 1 or 2;

$$(CH_2)_f\text{-Phen-W},$$

wherein W represents —$COO^-$ or $SO_3^-$;

Phen represents a phenyl group and f equals 1, 2, 3 or 4.

In another embodiment according to the method of the present invention in said dye corresponding to the general formula (II), the alkyl chain containing at least one latent solubilizing group containing alkyl chain corresponds to the formula $$(CH_2)_{m'}—(C=O)—O—CH_2—(C=O)—CH_3,$$

wherein m' is an integer having a value of from 1 to 5.

In a further preferred embodiment according to the method of the present invention said dye corresponds to formula (III) or formula (III)

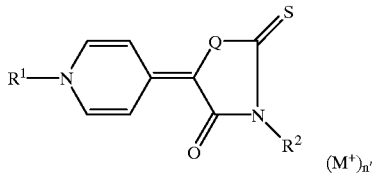

(IV)

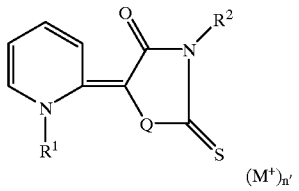

wherein Q, $M^+$, n', $R^1$ and $R^2$ have the same meaning as hereinbefore.

In a more preferred embodiment according to the method of the present invention said dye corresponds to the formula (V)

(V)

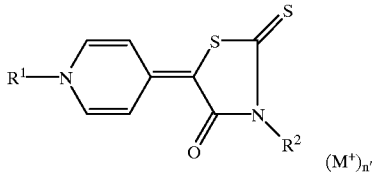

wherein $R^1$, $R^2$, n' and $M^+$ have the same meaning as hereinbefore.

In a particularly preferred embodiment according to the method of the present invention said dye corresponds to the formula (VI) or (VII)

(VI)

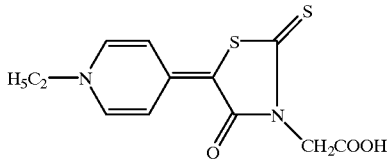

(VII)

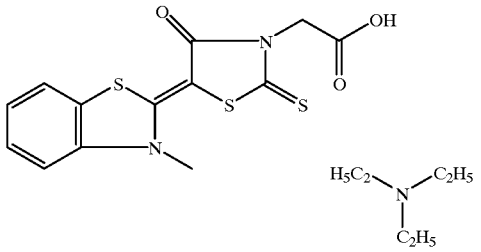

According to the method of the present invention a molar ratio of non-J-band aggregating to J-band aggregating dyes is from 1:20 up to 10:1 more preferably from 1:5 up to 5:1 and still more preferably from 1:5 up to 5:4. Expressed in mole per mole of silver the concrete dye anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyloxacarbocyanine hydroxide or its sulphopropyl derivative is thus added in an amount of from 0.20 up to a maximum amount of about 1 mmole per mole of silver, whereas the dye according to the formula (VII) hereinbefore is added in an amount of more than about 0.15 up to at most about 1.20 mmole per mole of silver. Opposite thereto, if used alone up to 2.8 mmole of J-band aggregating dye per mole of silver are added in order to get well-spectrally sensitized tabular emulsion grains.

Especially when amounts of JAD are decreasing the favorable effect of addition of increasing amounts of NJAD with respect to speed and absence of dye stain becomes, to a certain extent, more and more pronounced as will be clearly illustrated in the Examples: in a particularly preferred embodiment according to the method of the present invention one or more non-J-band aggregating dye(s) is(are) present in a total amount of more than 0.15 mmole per mole of silver and one or more J-band aggregating dye(s) is(are) present in a total amount of less than 1 mmole per mole of silver.

As has already been said hereinbefore the tabular silver halide emulsion used in the method of the present invention is an emulsion comprising tabular silver halide grains having an average aspect ratio of at least 2:1, an average crystal diameter from 0.3 $\mu$m to 3.0 $\mu$m and an average thickness of less than 0.50 $\mu$m account for at least 50% of the total projective surface area of said grains. In a preferred embodiment said average thickness of the said tabular silver halide grains is less than 0.30 $\mu$m, and preferably even less than 0.20 $\mu$m, i.e. not less than about 0.06 $\mu$m. Moreover in a more preferred embodiment said grains have an average aspect ratio of at least 5:1, more preferably between 5:1 and 20:1 and still more preferably between 8:1 and 15:1. Further said average crystal diameter, calculated as an average equivalent circular diameter from electron microscopic data obtained from all tabular grains present (which account for at least 50% of the total projective surface area of said grains as told hereinbefore) is more preferably from 0.3 $\mu$m up to 2.0 $\mu$m and even more preferably from 0.4 $\mu$m up to 1.0 $\mu$m.

According to the method of the present invention in said silver halide tabular grains said halide is selected from the group consisting of bromide, chloride and iodide. In case of tabular silver bromo(chloro)iodide emulsion crystals said bromide content is preferably at least 90 mole % and more preferably at least 95 mole % and even at least 98 mole %, whereas the silver iodide content is preferably less than 2 mole %, more preferably less than 1 mole %, still more preferably less than 0.2 mole % and even not more than 0.05 mole % in order to prevent inhibition in the developing step, thereby making rapid processing possible.

In case of tabular silver choro(bromo)iodide emulsion crystals said chloride content is preferably at least 90 mole %, more preferably at least 95 mole % and even at least 98 mole %, whereas the silver iodide content is preferably less than 2 mole %, more preferably less than 1 mole %, still more preferably less than 0.2 mole % and even not more than 0.05 mole %, again in order to prevent inhibition of the developing step, thereby promoting rapid processing.

As it is preferred to have as low an iodide content as set forth hereinbefore it is preferred to build in iodide ions as homogeneously as possible over the whole crystal volume of tabular crystal rich in silver bromide or over the outermost shell of tabular crystal rich in silver chloride. Silver iodide can be added by double jet addition of (preferably diluted) silver nitrate and potassium iodide solutions, by conversion making use therefore from a (preferably diluted) potassium iodide solution, by addition of iodide ions generated rapidly from an organic iodide releasing agent as has been described e.g. in EP-A's 0 563 708, 0 561 415, 0 562 476 and 0 563 701 or more preferably from ultrafine (homogeneous) silver iodide Lippmann emulsions (also called "micrate emulsions"), having an average crystal diameter of not more than 0.05 μm as has e.g been described in EP-A 0 475 191 and the corresponding U.S. Pat. No. 5,206,134.

Besides tabular crystals as described emulsions used in the method according to the present invention comprise a binder. A survey of binders useful in the method of the present invention has been described in Research Disclosure No. 38957, published Sep. 1, 1996, Chapter II. More detailed descriptions thereof can be found in EP-Application No. 96203203, filed Nov. 15, 1996 wherein the use of different types of gelatin as commonly used hydrophilic binder has been described in the emulsion preparation of tabular grains rich in silver bromide and in EP-A 0 677 773, wherein colloidal silica has been described as an alternative useful binder, just as cationic starch described e.g. in EP-A 0 758 758.

Tabular silver halide emulsions prepared by the method of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). Chemical sensitization has e.g. also been described in Research Disclosure N° 38957 (1996), Chapter IV. As described in said literature chemical sensitization can be carried out by effecting the ripening in the presence of small amounts of compounds containing sulphur e.g. thiosulphate, thiocyanate, thioureas, sulphites, mercapto compounds, and rhodamines. Said compounds containing sulphur can also be, at least partially, replaced by compounds containing selenium and/or tellurium. The emulsions may be sensitized also by means of gold-sulphur, gold-sulphur-selenium, gold-selenium ripeners or by means of reductors e.g. tin compounds as described in GB Patent 789,823, amines, hydrazine derivatives, formamidine-sulphinic acids, and silane compounds.

According to the method of the present invention chemical ripening of said tabular grains proceeds in the presence of combinations of sulphur, selenium and gold ion providing compounds. Such combination has e.g. been described in EP-A 0 443 453. More particular selenium compounds suitable for use in the method of the present invention have been described in U.S. Pat. Nos. 5,028,522; 5,112,133; 5,397,692 and 5,641,619; in EP-A 0 476 345, 0 566 074, 0 585 787, 0 661 589 and in EP-Application No 97200590, filed Mar. 1, 1997. Even a combination of selenium sensitization while adding silver iodide Lippmann emulsions is possible as has been described e.g. in EP-A 0 638 840. More particular gold compounds suitable for use in the method of the present invention have been described e.g. in U.S. Pat. No. 5,376,522 and 5,700,631. More particular sulphur compounds suitable for use in the method of the present invention have been described in U.S. Pat. No. 5,667,957. Combination with reduction sensitization as described in U.S. Pat. No. 5,573,901 is possible, provided that a suitable stabilizer or combination of stabilizers is added to the emulsion as well as described in U.S. Pat. No. 5,114,838.

According to the method of the present invention the J-band and non-J-band forming spectral sensitizers are added before addition of the chemical sensitizing compounds mentioned hereinbefore as has been disclosed already in the earliest patents with respect to tabular grain emulsions filed by E. Kodak in 1981, more particularly in U.S. Pat. Nos. 4,425,425 and 4,439,520. It is not important whether the non-J-band aggregating dye or the J-band aggregating dye(s) is(are) added as the first dye(s) to the tabular grain emulsions in the method of the present invention. Even a mixture of both of them can be made before addition to the emulsion.

According to the present invention a light-sensitive silver halide emulsion is thus provided, comprising tabular silver halide grains having an aspect ratio of at least 2:1, an average crystal diameter between 0.3 μm and 3.0 μm and an average thickness of less than 0.50 μm accounting for at least 50% of the total projective surface area of said grains, wherefore preferred embodiments have already been described hereinbefore, and wherein said grains have at least one J-band aggregating spectrally sensitizing dye and at least one non-J-band aggregating dye the particular embodiments of which have also already been described hereinbefore.

Light-sensitive silver halide emulsion according to the present invention are thus provided wherein one or more non-J-band aggregating dye(s) is(are) present in an amount of more than 0.15 mmole per mole of silver and wherein one or more J-band aggregating dye(s) is(are) present in an amount of less than 1 mmole per mole of silver. More in detail it should be clear that the amount of J-band aggregating spectrally sensitizing dye is always less than the normally (optimally) added amount when only one or more dyes of the same J-band aggregating type are present. The unexpected results are indeed related with the presence of non-J-band aggregating dyes when lower amounts of J-band aggregating dyes are present in that no loss in sensitivity is found besides a desired contrast and image definition and moreover the absence of residual dye stain after processing, even in rapid processing applications with reduced amounts of replenishers. The more "robust" or "preserved" film-processing system thus obtained is less depending on amounts of J-band aggregating spectrally sensitizing dye(s) if present as a sole type of dye as was hitherto well-known by someone skilled in the art of photography. One or more non-J-band aggregating dye(s) is(are) thus compensating for decreased amounts of J-band aggregating spectrally sensitizing dye.

Further additives may be added to the photographic emulsion of the present invention before coating as has e.g. been described in Research Disclosure (RD) No. 38957, p. 591–639, more particularly with respect to stabilizers as e.g. in Chapter VII of the said RD. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzo-triazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-A 75/39537, and GB-A 1,500,278, and 7 -hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

Many of these fog-inhibiting compounds may have been already added during the chemical ripening of the tabular silver halide crystals of the present invention as has already been suggested hereinbefore.

It is clear that additional gelatin or another polymeric binder is added in a later stage of the emulsion preparation, e.g. after washing, in order to establish optimal coating conditions and/or in order to establish the required thickness of the coated emulsion layer. Preferably a gelatin (as most preferred binder) to silver halide ratio ranging from 0.3 to 1.0 is then obtained, wherein extra gelatin added is not required to have a compostion as specific as in the preparation step of the grains according to the method of the present invention.

Another binder may also be added instead of or in addition to gelatin. Useful vehicles, vehicle extenders, vehicle-like addenda and vehicle related addenda have been described e.g. in Research Disclosure N°. 38957 (1996), Chapter II and in EP-A's 0 528 476 and 0 831 362.

The gelatinous emulsions according to the present invention comprising tabular grains and at least one J-band aggregating dye and at least one non-J-band aggregating dye can be used in various types of photographic elements, e.g. black and white silver halide photographic materials, like materials used for X-ray diagnostic purposes.

According to the present invention a light-sensitive silver halide photographic material, more preferably an X-ray photographic material, is further provided, said material comprising a support, at least one hydrophilic colloid layer on at least one side of said support and one or more photosensitive layer(s) comprising a silver halide photographic emulsion according to the present invention as set forth hereinbefore.

The binder of the photographic material having at least one gelatinous emulsion according to the present invention can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

In a preferred embodiment according to the present invention said photographic element or material comprises a support and on one or on each side thereof one or more silver halide emulsion layer(s) coated from a gelatinous emulsion according to this invention. More specifically said photographic material is a single-side or double-side coated X-ray material. The single-side coated X-ray material may contain one single emulsion layer, as it is the case for many applications, or it can be built up by two or even more emulsion layers. In X-ray photography a material with a single or a duplitized emulsion layer coated on one or both sides of the support thus contains at least one gelatinous silver halide emulsion according to the invention. By using duplitized emulsions differing in photographic speed by at least 0.15 log E a gain in cross-over exposure in double side coated materials can be obtained. In the case of color photography the material contains blue, green and red sensitive layers each of which can be single coated, but merely consist of double or even triple layers. Besides the light-sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes etc. The photographic element of the present invention may further comprise various kinds of coating physical property modifying addenda as described in Research Disclosure N°. 38957 (1996), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element of the present invention may further comprise various other additives such as e.g. compounds improving the dimensional stability of the photographic element, UV-absorbers, spacing agents and plasticizers. Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD N°. 38957 (1996), Chapter VI, wherein also suitable optical brighteners are mentioned. Spacing agents can be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The photographic material can contain several non-light sensitive layers, e.g. an antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. Nos. 4,092,168 and 4,311,787, in DE-A 2,453,217 and in GB-A 7,907,440. Situated in such an intermediate layer between the emulsion layers and the support there will be only a small negligable loss in sensitivity but in rapid processing conditions decoloration of the filter dye layers may form a problem. Therefor it should be recommended to decrease the thickness of the whole coated layer packet resulting in shorter drying times after washing in the processing cycle.

According to the present invention a radiographic screen-film combination is provided comprising at least one X-ray intensifying screen in operative association with a material according to the present invention as described hereinbefore. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trade-marked products of BAYER AG. One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an α-olefin polymer, e.g. a polyethylene layer which optionally contains an antihalation dye or pigment. It is also possible to use an organic resin support e.g. cellulose nitrate film, cellulose acetate film, poly(vinyl acetal) film, polystyrene film, poly(ethylene terephthalate) or poly(ethylene naphthalate) film, polycarbonate film, polyvinylchloride film or poly-α-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in a preferred embodiment of materials for X-ray diagnostic purposes said materials may be adapted to rapid processing conditions. Preferably an automatically operating processing apparatus is used provided with a system for automatic regeneration of the processing solutions. The forehardened material may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is e.g. possible to use (iso)-ascorbic acid, reductic acid or derivatives thereof instead or partially replacing the questionnable hydroquinone as main developing agent in the developer and sodium thiosulphate instead of ammonium thiosulphate as a fixing agent in the fixer solution.

The following examples illustrate the invention without however limiting it thereto.

6. EXAMPLES

In praxis spectral sensitizing dyes are called "J-band spectrally sensitizing dyes" or "J-band aggregating dyes" when the said dyes produce J-aggregates if adsorbed on the surface of the silver halide grains. J-aggregates are characterized by a sharp absorption band, called J-band, with a bathochromic shift with respect to the absorption maximum of the free dye in a diluted aqueous solution.

Therefore a sample of the silver halide emulsion was taken after ultrafiltration or redispersion (in the case of flocculation washing), before chemical sensitization (step during which labile sulphur and/or selenium and/or tellurium compounds were added, together with gold salts). To this unripened (so-called "primitive") emulsion sample a spectral sensitizing dye was added in following amounts in mole/mole of silver halide: 0 (blank); $1\times10^{-6}$; $1\times10^{-5}$; $1\times10^{-4}$; $1\times10^{-3}$; said emulsion having a pH of 5.5, a UAg of 70 mV (potential versus silver/silver chloride reference electrode) at 38° C. in a concentration of 60 g of silver nitrate per liter of the samples. The absorption spectra were taken for all samples, inclusive for the "blank" sample. In the case that by increasing the amount of spectral sensitizing dye one or more absorption peak(s) appear, wherein its absorption spectrum shows a bathochromic shift with a "small" bandwidth, corresponding with a bandwidth at one half of the total height of the peak of less than 40 nm, then the said dye is called a "J-aggregating" or "J-band aggregating" dye.

An emulsion sample of the "primitive" silver bromoiodide emulsion the preparation of which is given hereinafter, was therefore dissolved in demineralized water of 38° C. in order to get a concentration of about containing about 60 g of $AgNO_3$ per kg. pH was adjusted to a value of 5.5 and the UAg value (potential value expressed versus a Ag/AgCl reference electrode) was adjusted to a value of 70 mV with KBr). To each sample of this non-chemically ripened, non-stabilized emulsion amounts of a spectrally sensitizing dye per mole of silver nitrate present were added as given hereinbefore to the diluted solution. After 30 minutes absorption spectra were measured with a spectrophotometer (SHINADZU).

Differences between the spectra (spectrophotometric curve in the region from 400 to 700 nm) were calculated and registered as set forth hereinbefore, in order to detect the presence or the absence of "J-band aggregation" and thus to conclude that a "J-band" aggregating dye (JAD) or a "non-J-band" aggregating dye (NJAD) was present.

Example No. 1

Emulsion preparation

Three solutions were used during the precipitation:

Solution 1: 1.5 liter of an aqueous solution containing 500 grams of silver nitrate (1.96 N solution of silver nitrate);

Solution 2: 0.525 liter of an aqueous solution containing 175 grams of potassium bromide (1.96 N solution of potassium bromide).

Solution 3: 0.975 liter of an aqueous solution containing 320 grams of potassium bromide and 5 grams of potassium iodide (1.93 N potassium bromide; 0.03 N potassium iodide).

An emulsion having silver iodobromide emulsion crystals containing 1.0 mole % of silver iodide was prepared by following preparation steps, making use of the 3 solutions as set forth hereinbefore: a nucleation and a first neutralization step, a second neutralization step and a growth step, followed by a third and a fourth neutralization step, and a second growth step. Precipitation proceeded, making use of the double jet technique with continuous control of the pAg or pBr value, said value being defined as the negative logarithm of the silver ion or of the bromide ion concentration respectively, and with application, where required, of continuously varying addition rates of solutions to the reaction vessel.

Nucleation Step 8 ml of solutions 1 and 2 were introduced into a reaction vessel in 30 seconds using the double jet technique. Said reaction vessel initially contained 3 liter of demineralized water at 51° C., 1.5 grams of potassium bromide and 5.5 grams of oxidized gelatin (pH adjusted at a value of 1.8; pBr=2.39). After 90 s the reaction temperature of this mixture was raised to 70° C. in 25 minutes, pH was adjusted at a value of 6.0 and after 210 s 500 ml of an aqueous solution (10% by weight) of phthalated gelatin were added. After another 330 s waiting time a first neutralization step was started.

First and Second Neutralization Steps

In a time of 330 s at a rate of 7.5 ml/min. solution 2 was run into the reaction vessel, before starting a second neutralization step, during which solution 1 was run during 60 s at a rate of 7.5 ml/min. while simultaneously running solution 2 in the reaction vessel at a rate in order to maintain a constant pAg value of 8.85, whereafter growth was started.

First Growth Step

A double jet precipitation was started using solutions 1 and 2 which continued for 33 minutes 22 seconds. During this precipitation, the pAg value was kept constant at 8.85, by continuously adjusting the addition rate of solution 2, while adding 510 ml of solution 1 at a starting rate of 7.5 ml per minute, linearly increasing it to 23.1 ml per minute at the end. Thereafter the third neutralization step was started.

Third and fourth neutralization steps: solution 1 was added at a rate of 7.5 ml per minute during 440 s, immediately followed by a fourth neutralization step during which solution 1 was run during 100 s at a rate of 7.5 ml/min. while simultaneously running solution 2 in the reaction vessel at a rate in order to maintain a constant pAg value of 7.38, whereafter a second growth step was started.

Second Growth Step

A double jet precipitation was started using solutions 1 and 2 which continued for 40 minutes 56 seconds. During this precipitation, the pAg value was kept constant at 7.38, by continuously adjusting the addition rate of solution 2, while adding 907 ml of solution 1 at a starting rate of 7.5 ml per minute, linearly increasing it up to 36.8 ml per minute at the end of the precipitation.

After addition of sulphuric acid to a pH value of 3.5 stirring was stopped and after sedimentation the supernatant liquid was removed. The washing procedure was started after a scrape-rudder was installed and after addition of polystyrene sulphonic acid in the first turn to get a quantitative flocculate without silver losses.

During redispersion of the emulsion 150 g of gelatin were added in order to get a weight ratio of gelatin to silver nitrate of 0.4, the emulsion containing an amount of silver bromoiodide equivalent with 190 g of silver nitrate per kg.

After redispersion, every example was analyzed using shadowed carbon replicas obtained with an electron microscope. For each example a minimum of hundred grains were measured and the following characteristics were then calculated and a characterization of the crystal population of an emulsion was given by

- average thickness (t): calculated as the average by number from the distance between the main planes measured for all crystals;
- percentage of the total projective surface (% P.O.): percent part, expressed as silver, of the total projective area covered by the tabular grains;
- average equivalent volume diameter (EVD): average diameter, calculated from the average volume of all grains, expressed as diameter of a sphere having the same volume of the corresponding tabular crystal.

Emulsion grains prepared as described hereinbefore had following characteristics: t=0.18 μm; % P.O.=more than 95%; EVD=0.75 μm The emulsion thus prepared was divided in 4 parts. The emulsion crystals were chemically ripened with sulphur and gold in the presence of green light absorbing J-aggregating dyes as spectral sensitizing dyes and non-J-aggregating dyes at 47° C. for a time in order to get an optimized relationship between fog and sensitivity (speed). Addition sequence of the dyes was such that the non-J-aggregating dye (NJAD) was added after the green light absorbing J-aggregating dye (JAD). Amounts of dyes (in mmole/mole of silver) and moment of addition of said dyes ("BCR"=before chemical ripening; "ACR"=after chemical ripening) are given in the Table 1, together with sensitometric data obtained as explained hereinafter. A total amount of green light absorbing JAD was 1.26 and 0.63 mmole/mole of silver in the two comparative coatings respectively and 0.63 mmole/mole in the two inventive coatings to which increasing amounts of NJAD were added (0.32 and 0.64 mmole/mole respectively).

Following amounts of ingredients (differing from the dyes) were added to all emulsion parts (amounts added per mole of silver):

- 135 mg of potassium thiocyanate;
- 1 mg of sodium thiosulphate (including 5 moles of water per mole of the crystals, further indicated as "5aq.");
- 0.7 mg of gold thiocyanate (including 4 moles of water per mole of the crystals, further indicated as "4aq.").

Emulsion coatings (expressed per liter after addition of demineralized water in order to reach a concentration corresponding to about 200 g of silver nitrate per liter of coating solution):

- 785 mg of 4-hydroxy-6-methyl-1,3,3a,7-tetraazaindene as antifogging agent and stabilizer,
- 2.68 g of resorcin as hardening agent.

A protective coating composition was prepared containing per liter following ingredients in demineralized water:

- 35.4 g of an inert gelatin
- 37 g of silica sol containing silica particles (in an amount of 30 % by weight) having an average diameter of from 7 to 10 nm
- 20 g of an aqueous dispersion of matting agent with a particle size diameter of 2 μm comprising 3.2% of polymethylmethacrylate and 10% of gelatin
- 300 mg of ammoniumperfluoro-octanoate (FC143, trade name product from 3M) and 750 mg of N-polyoxyethylene-N-ethyl-perfluoro-octanesulfonamide (FC170C, trade name product from 3M) as surfactants
- 1500 mg of phenol as preserving agent
- 1000 mg of Mobilcer Q from MOBIL OIL as a lubricant.

Bis-(vinylsulphonyl)-methane was added as a hardening agent in an amount in order to have a swelling degree of the material of not more than 200% when immersing the hardened material for 3 minutes in demineralized water of 35° C.

The solutions for the emulsion coating and for the protective coating were coated simultaneously on both sides of a polyethylene terephthalate film support having a thickness of 175 μm, together with a protective layer containing per side and per square meter 1.1 g of gelatin and an emulsion layer having 3.5 g of silver, expressed as equivalent amount of silver nitrate.

Exposure,sensitometric and densitometric data: samples of these coatings were preserved for 3 days at a temperature of 57° C. and 34% RH and were exposed at both sides with visible light by projection lamps (130V; 250W) having an exposure voltage of 90V during 0.1 s at a distance of 1.8 m from the film, through a continuously varying carbon-coated wedge(wedge constant 0.15) with a densitometric filter with a density of 0.30 and a "Corning filter 4010" as a filter with a density 2.64 (measured with a Macbeth TR 924 densitometer), transmitting green light in the range between 500 and 580 nm and with a transmission maximum at 525 nm.

The exposed samples were processed during the 90 seconds cycle described below. The density as a function of the light dose was measured and therefrom were determined the following parameters:

fog level (with an accuracy of 0.001 density; figure given=1000 times fog D) and the relative speed at a density of 1 above fog (expressed in log E(xposure)): a lower value is thus indicative for a higher speed.

Stain was visually controlled: "Yes" if stain was still visible; "No" if there was no remarkable or disturbing stain density.

The automatic processing occurred in a glutaraldehyde containing hydroquinone/1-phenyl-3-pyrazolidinone developer followed by an aluminum containing fixer marketed by Agfa-Gevaert N.V. under the trade names G138 and G334 respectively.

CURIX 530, tradename of Agfa-Gevaert N.V. was used as an automatic processing machine. Processing sequence and conditions in the said CURIX 530 processing machine were following (expressed in seconds (sec.), temperature (in ° C.) added thereto:

| | |
|---|---|
| loading: | 3.4 sec. |
| developing: | 23.4 sec./35° C. in developer G138 (trade name) |
| cross-over: | 3.8 sec. |
| fixing: | 15.7 sec./35° C. in fixer G334 (trade name) |
| cross-over: | 3.8 sec. |
| rinsing: | 15.7 sec./20° C. |
| drying: | 32.2 sec. (cross-over time included) |
| total time: | 98.0 sec. |

The results of these experiments are summarized in Table 1.

TABLE 1

| Sample No. | BCR NJAD | BCR JAD | Stain | Fog | Speed |
|---|---|---|---|---|---|
| 1 (comp.) | 0 | 1.26 | Yes | 9 | 0.229 |
| 2 (comp.) | 0 | 0.63 | No | 12 | 0.314 |
| 3 (inv.) | 0.32 | 0.63 | No | 25 | 0.225 |
| 4 (inv.) | 0.64 | 0.63 | No | 31 | 0.171 |

From Table 1 hereinbefore it is clear that inventive samples Nos. 3–4 are illustrative for the present invention in that a remarkable gain in speed is attained if, before starting chemical ripening, to the tabular grain emulsion a non-J-band aggregating dye is added in an amount in order to compensate, in part (see 2 and 3 versus 1) or totally (see 4 versus 1), for the addition of a lower amount of absorbing J-band aggregating sensitizing dye (providing the absence of dye stain, but compare the loss in speed if only one half of the normally added amount of JAD is added as in sample No. 2 versus in sample No. 1.

Example No. 2

The same emulsion as in Example 1 was prepared and was divided in 9 parts after redispersing. The emulsion crystals were chemically ripened with sulphur, selenium and gold in the presence of green light absorbing J-aggregating dyes as spectral sensitizing dyes and non-J-aggregating dyes at 47° C. for a time in order to get an optimized relationship between fog and sensitivity (speed). Addition sequence of the dyes was such that the non-J-aggregating dye (NJAD) was always added after the green light absorbing J-aggregating dye (JAD). Amounts of dyes (in mg/mole of silver) and moment of addition of said dyes ("BCR"=before chemical ripening; "ACR"=after chemical ripening) are given in the Table 2, together with sensitometric data obtained as explained hereinafter. A total amount of added green light absorbing J-aggregating dye was always 1.26 mmole/mole of silver: if said total amount was not reached in the chemical ripening, an additional amount was added after chemical ripening in order to compensate therefore.

Following amounts of ingredients (differing from the dyes) were added to all emulsion parts (amounts added per mole of silver):

135 mg of potassium thiocyanate;

1.7 mg of sodium thiosulphate (5aq.);

1.2 mg of triphenyl phosphorselenide;

1.3 mg of gold chloride (4aq.).

Emulsion coatings Nos. 5–13 were the same as in Example No. 1, as well as exposure, processing and the significance of sensitometric and densitometric data:

TABLE 2

| Sample No. | BCR NJAD | BCR JAD | ACR JAD | Fog | Speed |
|---|---|---|---|---|---|
| 5 (comp.) | 0 | 0 | 1.26 | 30 | 0.246 |
| 6 (comp.) | 0 | 0.63 | 0.63 | 20 | 0.233 |
| 7 (comp.) | 0 | 1.26 | 0 | 13 | 0.200 |
| 8 (comp.) | 0.32 | 0 | 1.26 | 37 | 0.222 |
| 9 (comp.) | 0.64 | 0 | 1.26 | 45 | 0.198 |
| 10 (inv.) | 0.32 | 0.63 | 0.63 | 24 | 0.199 |
| 11 (inv.) | 0.64 | 0.63 | 0.63 | 29 | 0.175 |
| 12 (inv.) | 0.32 | 1.26 | 0 | 15 | 0.176 |
| 13 (inv.) | 0.64 | 1.26 | 0 | 19 | 0.152 |

From Table 2 hereinbefore it becomes clear that inventive samples Nos. 10–13 are illustrative for the present invention in that a remarkable gain in speed is attained if, before starting chemical ripening, to the tabular grain emulsion a non-J-aggregating dye is added after addition of green light absorbing J-aggregating sensitizing dye.

If the amount of non-J-aggregating dye is increased speed is increased without too high a fog increase. An optimized fog-sensitivity relationship with a remarkable increase in speed is thus obtained if compared with the comparative material samples Nos. 5–9.

Addition (in part) of JAD after chemical ripening, although leading as in inventive material samples Nos. 10 and 11 to the same or a higher speed (vs. comparative samples Nos. 8 and 9) if more non-J-aggregating dye is present in the chemical ripening, leads to a higher fog and a lower speed if compared with the inventive samples Nos. 12 and 13 and is thus less advantageous from the point of view of reaching an optimized fog-speed relationship.

Example No. 3

The same emulsion as in Example No. 1 was prepared. After redispersion the said emulsion was divided into 12 parts. The emulsion crystals were chemically ripened with sulphur and gold in the presence of a green light absorbing J-aggregating dye as spectral sensitizing dye and a non-J-aggregating dye at 47° C. for a time in order to get an optimized relationship between fog and sensitivity (speed). Addition sequence of the dyes was such that the non-J-aggregating dye (NJAD) was always added after the green light absorbing J-aggregating dye (JAD). Amounts of dyes (in mg/mole of silver) added before chemical ripening are given in the Table 5 hereinafter, together with sensitometric data obtained as explained hereinbefore, except for gradations (contrasts) and residual color or dye stain. Exposures in these experiments were performed on the emulsion side of the single-side coated material only.

Following amounts of ingredients (differing from the dyes) were added to all emulsion parts (amounts added per mole of silver):

135 mg of potassium thiocyanate;

2.3 mg of sodium thiosulphate (5aq.);

4 mg of gold chloride (4aq.).

Following coating agents were added to the emulsion before coating the emulsion layer (see Table 3 hereinafter):

TABLE 3

| Compound (amounts per mole silver halide) | Emulsion layer |
|---|---|
| 4-hydroxy-6-methyl-1,3,3a,7-tetraazaindene | 87 mg |
| 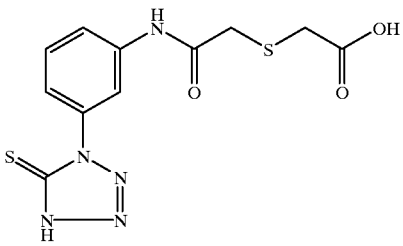 | 33 mg |
| sorbitol | 15.5 g |
| polyethylacrylate, latex plasticizer | 1.2 g |
| resorcinol | 2.8 g |
| potassium bromide | 160 mg |
| polydextran (M.W. 10,000) | 15 g |

The coating of the photographic materials was so that only one emulsion layer and one protective layer was present on only one side of the support. The coating solutions of the emulsion layers were prepared by adding solutions of the compounds indicated in Table 3 to the melted emulsion while stirring. The coating solution of the protective layer is given in Table 4.

After adjusting pH to a value of 6.7, the viscosity and surface tension of the coating solutions were optimized according to the requirements of the coating method. The emulsion layer(s) and the protective layer were coated simultaneously on one side of a substrated polyester support having a thickness of 175 $\mu$m by means of conventional coating techniques. The silver coverage of the emulsions was about 7 g/m$^2$, expressed as an equivalent amount of silver nitrate.

Following coating agents, summarized in Table 4, were added to the solution of the protective coating before coating the protective antistress layer.

TABLE 4

| Compound | amounts per m$^2$ |
|---|---|
| gelatin | 1.1 g |
| polymethylmethacrylate spacing agent (average particle diameter 3 mm) | 15 mg |
| 4-hydroxy-6-methyl-1,3,3a,7-tetraazaindene | 82 mg |
| bis-metasulphophenyl-disulphide | 4 mg |
| $CF_3$—$(CF_2)_6$—COOH.NH3 | 7.5 mg |
| $CF_3$—$(CF_2)_6$—CONH—$(CH_2CH_2O)_{17-20}$—H | 19 mg |
| phenol | 150 mg |
| 1-phenyl-4-methyl-3-pyrazolidone | 0.13 mg |
| Mobilcer Q (a paraffin wax, trade name product from MOBIL OIL) | 25 ml |
| polythioether A[(a)] | 5 mg |
| formaldehyde (added just before coating) | 100 mg |

(a) in Table 4 is polythioether A, a modified polyepichlorohydrine having an average chain length of approximately 20 monomer units and of which about 50% of the chloride groups have been replaced by a —S—$CH_2$—CHOH—$CH_2$OH substituent.

Separate strips of the coated materials were subsequently exposed for the same exposure time of 2 seconds to white light, filtered with a U535-green light filter.

Processing was performed in just the same automatic processing machine, in the same developer and fixer and in the same processing time as in Examples Nos. 1 and 2.

Table 5 shows the sensitometric results in terms of sensitivity (as log E(xposure)): the lower the figure, the more sensitive is the emulsion) and overall contrast GG for the photographic strips coated, exposed and processed as set forth hereinbefore. Amounts of dyes are given in mole/mole of silver as in the Examples hereinbefore.

The values given in Table 5 for the overall contrast GG the gradation was measured from the characteristic curve over a density range of 1.75 starting from a density value of 0.25 up to 2.00 above fog. Both gradations have been multiplied by a factor of 100.

Further an evaluation of dye stain was given ("NO", "SLIGHT" or "YES") as a result of visual inspection of the processed strips.

From Table 5 hereinafter it can be concluded that in order to significantly improve dye stain the amount of J-band aggregating dye, expressed in mg per mole of silver (nitrate), should be not higher than about 0.5 mmole/mole of silver. This however results in a loss in speed and contrast, a loss in speed which is partly decreased by addition of a non-J-band aggregating dye and which unexpectedly results in an increased contrast as is particularly desired for mammographic applications.

TABLE 5

| Matl. No. | JAD | NJAD | Speed | GG | Stain |
|---|---|---|---|---|---|
| 1 (comp.) | 1.230 | 0 | 0.126 | 275 | YES |
| 2 (comp.) | 0.941 | 0 | 0.129 | 285 | YES |
| 3 (comp.) | 0.701 | 0 | 0.150 | 270 | SLIGHT |
| 4 (comp.) | 0.470 | 0 | 0.168 | 247 | NO |
| 5 (comp.) | 1.230 | 0.314 | 0.130 | 269 | YES |
| 6 (inv.) | 0.941 | 0.314 | 0.133 | 275 | SLIGHT |
| 7 (inv.) | 0.701 | 0.314 | 0.135 | 309 | NO |
| 8 (inv.) | 0.470 | 0.314 | 0.155 | 285 | NO |
| 9 (comp.) | 1.230 | 0.629 | 0.146 | 299 | YES |
| 10 (inv.) | 0.941 | 0.629 | 0.142 | 305 | SLIGHT |
| 11 (inv.) | 0.701 | 0.629 | 0.146 | 312 | NO |
| 12 (inv.) | 0.470 | 0.629 | 0.156 | 312 | NO |

It can thus be concluded that for lower amounts of J-band aggregating dyes added to the silver halide emulsion the best relation between speed and contrast is attained, without leaving residual color (also called "dye stain"), thus leading to a more robust system from the viewpoint of sensitometry and image quality.

What is claimed is:

1. Method for preparing a tabular silver halide emulsion wherein tabular silver halide grains having an average aspect ratio of at least 2:1, an average crystal diameter from 0.3 $\mu$m to 3.0 $\mu$m and an average thickness of less than 0.50 $\mu$m accounting for at least 50% of the total projective surface area of said grains, said method having the consecutive steps of precipitating, spectrally sensitizing and chemically ripening said grains, characterized by spectrally sensitizing the said grains by adding before chemically ripening one cyanine dye of formula (I) having a maximum J-band absorption in a wavelength range from 540 nm to 555 nm and one merocyanine dye of formula (II) and absorbing irradiation having a wavelength between 380 and 500 nm in an addition sequence such that said merocyanine dye is added after said cyanine dye, wherein the formula (I) and the formula (II) correspond to (I)

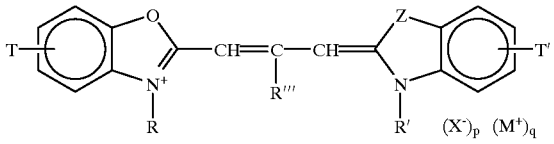

wherein

Z represents a nitrogen or an oxygen atom and is substituted with R" if Z is a nitrogen atom, R, R' and R" each independently represent alkyl, R'" represents hydrogen, alkyl or aryl, T and T' each independently represent 5-phenyl, 5-Cl, 5-$OCH_3$ and 5-$CH_3$, $(X^-)_p$ represents a negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound; and (II)

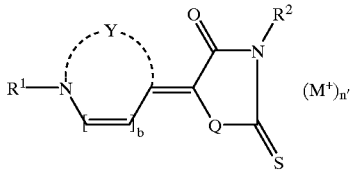

wherein

Y represents the atoms, necessary to form a heterocyclic 5- or 6-membered ring;

Q represents S, $NR^3$, O, or —(C=O)—N($R^4$)—;

$M^+$ represents a cation;

n' equals 0, 1, or 2;

b equals 0 or 1;

$R^1$, $R^2$, $R^3$ and $R^4$ each independently represents a $C_1$–$C_5$ alkyl chain, with the proviso that at least one of $R^2$, $R^3$ and $R^4$ has a solubilizing group or a latent alkali solubilizing group.

2. Method according to claim 1, wherein said dye(s) according to the formula (II) is (are) present in a total amount of more than 0.15 mmole per mole of silver and wherein said dye(s) according to the formula (I) is(are) present in a total amount of less than 1 mmole per mole of silver and wherein said dyes according to the formula (II) and to the formula (I) are present in a molar ratio from 1:5 up to 5:4.

3. Method according to claim 1, wherein chemically ripening said tabular grains proceeds in the presence of combinations of sulphur, selenium and gold ion providing compounds.

4. Method according to claim 1, wherein in said silver halide tabular grains said halide is selected from the group consisting of bromide, chloride and iodide.

5. Method according to claim 1 wherein said cyanine dye corresponds to formula (I)

(I)

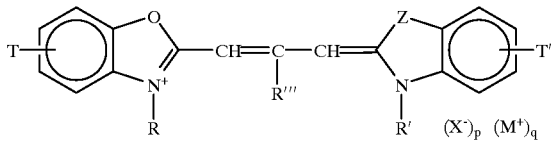

wherein

Z is a nitrogen atom,

R and R' each represent an alkyl,

R'" is hydrogen,

T represents 5-phenyl, 5-Cl, 5-$OCH_3$ or 5-$CH_3$,

T' represents 5,6-$(Cl)_2$, 5-CN-6-Cl, 5-$CF_3$-6-Cl, 5-Cl, 5-CN, 5-$CF_3$, 5-$CHF_2$, 5-$SO_2CH_3$ or 5-$SO_2$R"""' wherein R"""' represents an alkyl group, 5-COOR"""', 5-$SO_2$-N($R^x$)($R^y$), or 5-CO-N($R^x$)($R^y$) wherein $R^x$ and $R^y$ each independently represent an alkyl group which may form a ring with the nitrogen atom to which $R^x$ and $R^y$ is attached;

$(X^-)_p$ represents a negatively charged atom or group of atoms to compensate for positive charge(s) present on the dye, and $(M^+)_q$ represents a positively charged atom or group of atoms to compensate for negative charge(s) present on the dye; wherein p and q each represent an integer in order to get an electronically neutral compound.

6. Method according to claim 1, wherein said at least one merocyanine dye, according to the formula (II) absorbs irradiation having a wavelength between 420 and 460 nm.

* * * * *